US005697994A

United States Patent [19]

Packer et al.

[11] Patent Number: 5,697,994

[45] Date of Patent: Dec. 16, 1997

[54] PCD OR PCBN CUTTING TOOLS FOR WOODWORKING APPLICATIONS

[75] Inventors: Scott M. Packer, Pleasant Grove, Utah; Arturo A. Rodriguez, Bloomfield, Mich.; Stefan Ederyd, Saltsjöboo, Sweden; Ghanshyam Rai, Sandy, Utah

[73] Assignees: Smith International, Inc., Houston, Tex.; Sandvik AB, Sandviken, Sweden

[21] Appl. No.: 440,772

[22] Filed: May 15, 1995

[51] Int. Cl.[6] ..... B24G 3/00

[52] U.S. Cl. ..... 51/309; 428/332; 428/334; 428/469; 428/472; 428/408; 428/698; 428/704; 51/307

[58] Field of Search ..... 428/408, 698, 428/704, 472, 469, 332, 334; 51/307, 309

[56] References Cited

U.S. PATENT DOCUMENTS

| | | | |
|---|---|---|---|
| 3,918,219 | 11/1975 | Wentorf et al. | 51/307 |
| 3,944,398 | 3/1976 | Bell | 51/307 |
| 4,016,244 | 4/1977 | Susa et al. | 423/290 |
| 4,334,928 | 6/1982 | Hara et al. | 75/238 |
| 4,342,595 | 8/1982 | Bourdeau | 75/238 |
| 4,343,651 | 8/1982 | Yazu et al. | 75/238 |
| 4,389,465 | 6/1983 | Nakai et al. | 428/698 |
| 4,394,170 | 7/1983 | Sawaoka et al. | 75/233 |
| 4,566,905 | 1/1986 | Akashi et al. | 75/244 |
| 4,590,034 | 5/1986 | Hirano et al. | 419/13 |
| 4,596,693 | 6/1986 | Ishizuka et al. | 419/16 |
| 4,619,698 | 10/1986 | Ueda et al. | 75/238 |
| 4,647,546 | 3/1987 | Hall et al. | 501/96 |
| 4,650,776 | 3/1987 | Cerceau et al. | 501/96 |
| 4,693,746 | 9/1987 | Nakai et al. | 75/238 |
| 4,837,089 | 6/1989 | Araki et al. | 428/552 |
| 4,883,648 | 11/1989 | Davies et al. | 423/290 |
| 4,911,756 | 3/1990 | Nakai et al. | 75/238 |
| 4,950,557 | 8/1990 | Nakai et al. | 428/698 |
| 5,015,265 | 5/1991 | Corrigan et al. | 51/293 |
| 5,034,053 | 7/1991 | Naki et al. | 75/238 |
| 5,037,704 | 8/1991 | Nakai et al. | 428/550 |
| 5,043,120 | 8/1991 | Corrigan | 264/67 |
| 5,271,749 | 12/1993 | Rai et al. | 51/295 |
| 5,326,380 | 7/1994 | Yao et al. | 51/293 |

*Primary Examiner*—Archene Turner
*Attorney, Agent, or Firm*—Christie, Parker & Hale, LLP

[57] ABSTRACT

A cutting tool for woodworking applications has a tungsten carbide substrate and a hard layer bonded to the substrate at high temperature and high pressure, i.e. where diamond or cubic boron nitride is thermodynamically stable. The hard layer comprises polycrystalline diamond or polycrystalline cubic boron nitride, and a supporting cobalt phase including adjuvant alloying materials for providing oxidation and corrosion resistance. Typical alloying elements include nickel, aluminum, silicon, titanium, molybdenum and chromium. Such materials also retard transformation of cobalt from the HCP to the FCC crystal structure at high temperature. The hard layer has an as-pressed surface parallel to the substrate and is only about 0.3 millimeters thick. An additional secondary phase including a carbide, nitride and carbonitride of metals such as titanium may also be present in the PCD or PCBN layer.

9 Claims, 1 Drawing Sheet

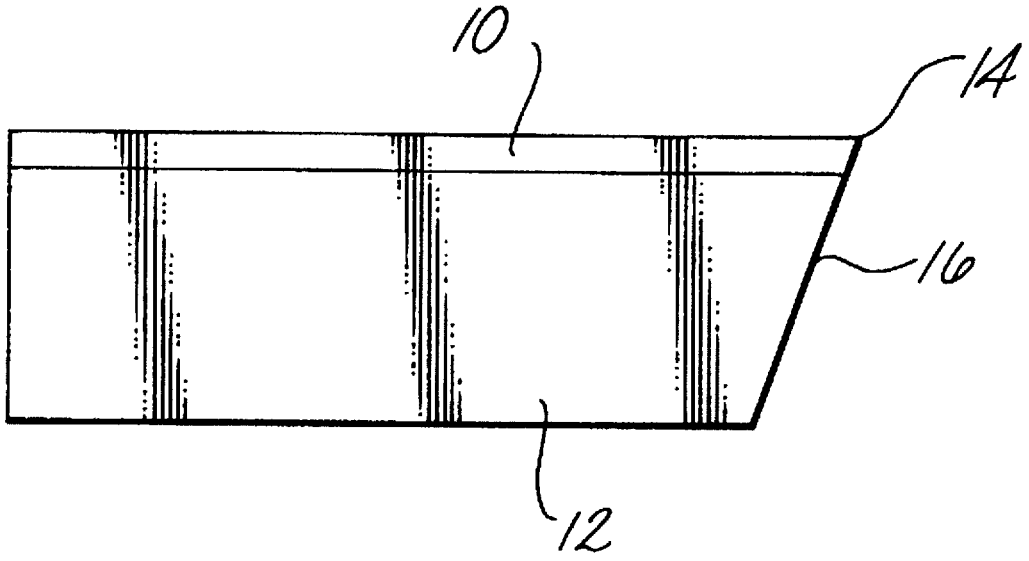
10
14
16
12

PCD OR PCBN CUTTING TOOLS FOR WOODWORKING APPLICATIONS

FIELD OF THE INVENTION

This invention relates generally to sintered polycrystalline abrasive compacts of diamond and cubic boron nitride for fabrication into cutting tools for woodworking applications. More particularly, this invention relates to a process for manufacturing oxidation and corrosion resistant polycrystalline diamond compacts by adding adjuvant alloying materials to the supporting cobalt phase which form stable oxide, chloride and sulfide compounds. Low cost cutting tools, suitable for woodworking applications, are fabricated from the polycrystalline diamond compacts and from polycrystalline cubic boron nitride compacts.

BACKGROUND OF THE INVENTION

Reconstituted wood products, such as medium density fiberboard and chipboard, together with solid wood, are the main raw materials used to produce decorative wood products for the furniture and housing industries. Fanciful designs and compound curves are typically machined from wood raw materials with a variety of cutting tools developed for use in wood working applications. In particular, tools fabricated of high speed steel, cemented carbides and polycrystalline diamond (PCD) materials have been used, with varying degrees of success, for woodworking. The most popular woodworking tools are those constructed of cemented carbides and PCD materials.

PCD, in particular, is preferred to metal cutting tools in woodworking applications because it is chemically more stable, has a higher temperature threshold and is not catalytically degraded by high temperature cutting operations. In the applications mentioned above, the primary qualities desired for a polycrystalline PCD compact tool are abrasive wear resistance, thermal stability, high thermal conductivity, impact resistance, and a low coefficient of friction in contact with the workpiece. While PCD itself possess each of these qualities to a significant degree, whether a polycrystalline compact of PCD as a whole possesses them will depend largely on the characteristics of the other materials that will make up the compact, i.e., binder material, catalysts, substrates, and the like, along with processing parameters such as surface cleanliness, surface flatness, grain size and the like.

Abrasive wear resistance has long been considered of primary importance in determining the suitability of a particular composition for woodworking purposes. Abrasion has been considered the primary mechanism for tool cutting edge degradation when machining reconstituted wood products. However, recent investigations have shown that degradation of the cutting edge of a PCD tool is accelerated by chemical attack of the supporting cobalt phase through oxidation and corrosion of the cobalt phase, as the temperature increases during cutting operations.

Over 213 different chemical compounds have been identified as decomposition products during the machining of various solid woods. Reconstituted wood products comprise additional materials formed or added as an adjunct to the manufacturing process such as urea, formaldehyde, glue fillers, extenders, and possible flame retardant chemicals. Reconstituted wood products, therefore, produce even more decomposition products upon machining, some of which are chemically quite aggressive. PCD cutting tools presently available to the woodworking industry are not adapted to resist these kinds of chemical attack.

Chemical degradation of PCD tool edges is a two stage mechanism that is, generally, temperature dependent. During the initial cutting period, temperatures are low, typically in the range from about 300° C. to 500° C. At these temperatures, wood decomposition products remain relatively stable and are introduced into the environment proximate to the cutting tool. Highly corrosive forms of, particularly, sulphur and chlorine containing compounds attack the cobalt phase that surrounds the PCD matrix, by forming cobalt chlorides and sulfides. These cobalt compounds are less thermodynamically stable and more easily eroded than the metal supporting phase. Support for the diamond to diamond bonding is weakened, thus causing the cobalt to abrade away more quickly, resulting in accelerated wear.

During later, typically higher temperature cutting periods above about 500° C., sulfur and chlorine containing decomposition products are volatilized and thus removed from the region proximate to the cutting tool. However, degradation of the cutting edge now proceeds by oxidation of the cobalt phase in air. A normal temperature gradient along the cutting tool places the highest temperature and thus the greatest oxidation potential at the point of interface between the workpiece and the cutting edge of the tool. Cobalt oxides are easily removed by mechanical abrasion, resulting in swift degradation of the sharpness of the cutting edge.

An additional disadvantage of presently available PCD cutting tools is that they are typically designed for use in machining ferrous metals rather than wood products. PCD tools used in the woodworking industry are similar to the ones used in the automotive and aerospace industries. Various adjuvant materials are incorporated in the PCD hard layer to obtain desired physical characteristics such as impact resistance depending on the particular application of the cutting tool. However, these materials do not provide the required oxidation and corrosion resistance for woodworking applications. Moreover, the bulk physical characteristics of these prior art PCD metalworking tools make them unsuitable for use as woodworking tools.

The hard layer thicknesses of PCD compact tools are commonly about 0.9 millimeter. The periphery of these products are cut to the desired shape by wire electrical discharge machining (EDM) and their surfaces are lapped and polished with diamond wheels or electrical discharge grinding (EDG). These are time consuming fabrication operations which result in an expensive cutting tool that, while it may be well adapted for use in machining metal parts, is not especially suitable for woodworking.

The thick PCD hard layer makes the tool susceptible to micro cracking caused by a volume change of the cobalt phase at temperatures above about 500° C. Cobalt may undergo a phase transformation from a hexagonal-close-packed crystal structure to a face-centered-cubic structure at elevated temperatures, which causes the volumetric change. The micro cracks are more easily attacked chemically as well as more easily abraded away by mechanical action.

Although the prior art discloses the advantages of making a PCD compact using a variety of supporting phase materials, it does not disclose the process of combining these or other adjuvant materials in the appropriate amount to produce an improved polycrystalline PCD compact which is oxidation and corrosion resistant for woodworking applications. Further, the methods described in the prior art are not the most economically advantageous methods for making a PCD compact for fabrication into a wood cutting tool because of the excessive material and fabrication cost associated with using a PCD compact designed for conventional metal cutting applications as a starting material.

It is therefore highly desirable to provide a method for making a sintered polycrystalline PCD compact, comprising the use of various adjuvant materials that act to retard the oxidation and corrosion of the cobalt phase and impart to the sintered PCD compact the level of abrasive wear resistance, impact resistance, and stability needed to perform as a wood cutting tool. It is also desirable that cutting tools fabricated from the polycrystalline PCD compact be cost effective in terms of starting material and fabrication costs.

BRIEF DESCRIPTION OF THE DRAWING

The drawing shows a side view of a simple cutting tool for use in woodworking.

SUMMARY OF THE INVENTION

A cutting tool for woodworking applications has a substrate (such as cemented tungsten carbide) and a hard layer of polycrystalline diamond or polycrystalline cubic boron nitride bonded to the substrate at high temperature and high pressure, i.e. where diamond or cubic boron nitride is thermodynamically stable. The hard layer also comprises a supporting cobalt phase including adjuvant alloying materials for providing oxidation and corrosion resistance. Typical alloying elements include nickel, aluminum, silicon, titanium, molybdenum and chromium. Such materials also retard transformation of cobalt from the hexagonal-close-packed crystal structure to a face-centered-cubic crystal structure at elevated temperatures. Preferably, the hard layer has an as-pressed surface parallel to the interface between the substrate and the hard layer and is only about 0.3 millimeters thick. An additional secondary phase including a carbide, nitride or carbonitride of metals such as titanium may also be present in the hard layer.

DETAILED DESCRIPTION

When creating a polycrystalline diamond (PCD) or polycrystalline cubic boron nitride (PCBN) compact for fabrication into a cutting tool for woodworking applications, it is enough that the edge of the tool contains a hard, corrosion and oxidation resistant layer comprising PCD or PCBN and a heat-resistant/wear-resistant material as a supporting phase. Therefore, it is advantageous to form a composite compact which comprises a polycrystalline diamond or PCBN hard layer 10 and a cemented carbide substrate 12 integral with the former, in view of the cost and the strength of the tool.

The tungsten carbide substrate 12 is "cemented" by sintering grains of tungsten carbide together with a cobalt phase. The term tungsten carbide is used herein and it should be recognized that the material may include TiC, TaC and/or NbC as well. Typically, the tungsten carbide grains are bonded wit from about 5 to 15% by weight cobalt. Other iron group binders may also be used. Methods of forming cemented tungsten carbide are well known.

An exemplary tool as illustrated in the drawing comprises such a composite compact with a cutting edge 14 at one end of the PCD layer at an angle to the interface between the substrate and hard PCD layer. The cutting tool may take many other configurations, including fluted cutters, routers, saw teeth and the like.

The thickness of the PCD or PCBN hard layer 10 in the composite compact varies according to the composition of the hard layer as well as the shape of the cutting tool to be made. For a PCD compact of 300 grade, for example, wherein the average diamond particle size is approximately 5 microns, the hard layer is preferably no more than about 0.3 millimeter (0.01 inch) thick. PCBN composite compacts comprise a hard layer preferably in the range from about 0.3 to 0.9 millimeter (0.01 to 0.035 inch) thick.

A tungsten carbide substrate is desirable since it has a high degree of hardness, heat conductivity, and toughness. The thickness of the cemented tungsten carbide substrate for a PCD compact is generally about 1.7 millimeters giving an overall thickness of about 2.0 millimeters for the PCD compact. The thickness of the cemented tungsten carbide substrate for a PCBN compact is generally about 2.1 millimeters giving an overall thickness of about 3.0 millimeters for the PCBN compact.

Various methods of making a composite compact comprising PCBN or PCD and a cobalt phase and sintered to a tungsten carbide (WC), or other similar substrate, are known. For example, U.S. Pat. No. 5,326,380 to Yao, the disclosure of which is expressly incorporated herein by reference, describes a process for forming a PCBN compact wherein cubic and wurtzite boron nitride crystals are compacted into a preform, along with various adjuvant materials, and subjected to heat and pressure.

Briefly, a composite PCD compact, for example, is created by placing a mixture of diamond crystals, cobalt powder, and optionally, refractory materials or other adjuvants onto a cobalt cemented tungsten carbide substrate, and loading them together into a closed container. Careful selection of container materials minimizes infiltration of undesirable materials into the compact and protects it from oxidation and the like. Careful selection of container materials also minimizes surface irregularities on the as-pressed (or as-sintered) surface of the finished compact. While molybdenum, niobium, titanium, tungsten, and zirconium have been found to be suitable, the preferred container material is niobium.

A closed niobium container enclosing the substrate and the diamond mixture to be sintered is surrounded by any well known pressure transmitting medium such as salt, talc, or the like. The container and pressure transmitting medium are placed in a graphite or metallic heater surrounded by a pressure transmitting and gasket forming material such as pyrophyllite and placed into the chamber of a suitable high pressure, high temperature (or super-pressure) press. After pressure in excess of about 20 kilobars is applied to bring the mixture into the region where diamond or CBN is thermodynamically stable, as is well known to those skilled in the art, electrical resistance heating is applied to sinter the compact to maximum density. A suitable cycle comprises a pressure of up to about 75 kilobars at a temperature of about 1400° C. for 5 to 15 minutes.

After sintering is complete, the heating current is decreased and the sample is cooled below about 200° C., after which the applied pressure is removed and the container is taken from the high pressure press. The compact is removed from the container and readied for use in its final form.

In the preferred embodiments of a composite compact, diamond or cubic boron nitride crystals of a particular size suitable for the intended application of the compact are thoroughly blended with a mixture of materials for forming a supporting phase.

In some embodiments, supporting phase materials include a carbide, nitride or carbonitride containing refractory material of the group IVb, Vb, and VIb transition metals of the periodic table. The preferred carbide, nitride or carbonitride containing refractory material of the group IVb, Vb, and VIb transition metals is titanium carbonitride (for convenience referred to as TiCN) or titanium aluminum carbonitride (TiAlCN) and may comprise from about 2 percent to about 40 by weight of the total mixture. TiCN or TiAlCN imparts chemical wear resistance to the compact and a compact having less than 2 percent by weight TiCN or TiAlCN does not possess the chemical resistance needed to function as a desirable woodworking tool. Because TiCN is relatively softer than either diamond or cubic boron nitride, a mixture comprising a greater amount than about 50 percent by weight of TiCN or TiAlCN produces a compact having decreased abrasive wear resistance.

If desired, tungsten carbide (WC) may be added as a refractory material up to about 8 percent by weight of the total mixture. The preferred amount of carbide, nitride or carbonitride containing refractory material is in the range of from 5 to 50 percent by weight of the total mixture of diamond or cubic boron nitride and other materials.

The carbide, nitride or carbonitride containing refractory material selected from the group IVb, Vb, and VIb transition metals is known to have high abrasive wear resistance, heat resistance and chemical resistance characteristics. However, the abrasive wear resistant qualities of this refractory material does not surpass that of PCD or PCBN alone. Accordingly, the weight percent of the carbide, nitride, or carbonitride refractory material used in the mixture reflects a tradeoff between the increased heat resistance and chemical resistance and the tendency to reduce either PCD or PCBN's inherent abrasive wear resistance.

In practice, a mixture comprising less than about 50 percent by weight nitride, carbide or carbonitride containing refractory material produces a PCD/PCBN compact having a reasonably high degree of chemical resistance, heat resistance and abrasive wear resistance suitable for woodworking operations.

Increased wear resistance is also provided by boriding a group IVb, Vb or VIb metal carbide. Boriding is effected by mixing a compound comprising a boride of a group VIII material, such as $Co_3B$, for example, with the carbide. Such group VIII borides melt at sufficiently low temperatures to be useful in composite compact fabrication and are compatible with both diamond and CBN crystals. In order to insure enhanced intergranular bonding it is preferred that the particle size of the adjuvant material be approximately equal to that of the diamond crystals. As finer-grained compacts give greater impact resistance, perform suitably in aggressive cutting applications, and give smoother surfaces in finishing applications, a diamond or CBN particle size less than about five microns is preferred. It is preferred that the adjuvant materials have a particle size less than about ten microns, and that the oxide, carbide, nitride or carbonitride containing material have a particle size less than about two microns.

The diamond or CBN crystals are combined with the other materials in the preferred weight ratio and thoroughly blended with cemented tungsten carbide balls and alcohol in a nitrogen charged ball mill. The mixture is compacted, and in the case of cubic boron nitride formed into preforms, and heat treated in a non-oxidizing or reducing atmosphere at a temperature in the range of from 600° to 1000° C. for a duration of up to about 4 hours. Preferably, a temperature of 1000° C. is used. The non-oxidizing atmosphere may either be $10^{-4}$ to $10^{-6}$ Torr vacuum, hydrogen or ammonia. For CBN compacts, treatment in ammonia at a temperature in the range of 1000° to 1250° C. is preferred. If the temperature is less than about 600° C., boron oxide, $B_2O_3$, on the surface of cubic boron nitride crystals may not volatilize.

The preferred method of producing a composite compact is as follows. A substrate alloy of a suitable shape is prepared from a cemented metal carbide such as tungsten carbide cemented with cobalt. A mixture of either diamond or cubic boron nitride (CBN) crystals, and other materials for forming a hard layer as an effective cutting edge is put on the substrate. The assembly is then hot-pressed by a super-pressure apparatus to sinter the hard layer and at the same time to bond either the diamond or CBN crystals to the cemented carbide substrate. During the hot pressing, the cobalt containing liquid phase of the cemented carbide substrate infiltrates into the clearances between, for example, the diamond particles, thus, forming a bond between the PCD compact and the cemented tungsten carbide substrate. In like manner, a cobalt phase infiltrates between cubic boron nitride particles, promoting intergranular bonding among the particles, and bonding the cubic boron nitride layer to the tungsten carbide substrate.

Cobalt powder may be included in the mixture placed on the cemented carbide substrate, in which case there is minimized infiltration of the cobalt phase from the substrate. The infiltrated material from the substrate is believed to be a pseudo-eutectic composition between about 60% cobalt and 40% tungsten carbide, accounting for presence of about ⅓ tungsten in the cobalt or metal phase of the composite.

Such a compact includes polycrystalline diamond (PCD) or polycrystalline cubic boron nitride (PCBN), a second phase which is a carbide, nitride or carbonitride containing refractory material of the group IVb, Vb, and VIb transition metals, and a third phase mainly composed of cobalt alloy further including adjuvant materials for oxidation and corrosion resistance. The refractory materials have a lower rigidity than either PCD or PCBN, and more easily deform under super-pressures to form a densely compacted powder body before the appearance of the liquid phase. As a result, there will occur only minimal permeation of the liquid phase of the cemented tungsten carbide substrate into the PCD during hot pressing under super-pressures.

Adjuvant materials added to enhance the oxidation resistance of the compact include elements from groups IIIa, IVa and Va of the periodic table, for example aluminum and silicon. In addition, alloying elements, such as tungsten, titanium, chromium, molybdenum, nickel, and other elements from groups IVb, Vb, and VIb of the periodic table may be added to the cobalt phase in order to enhance its oxidation and corrosion resistance. Either or both of such adjuvants may be added. The adjuvants need not be present in elemental form and are often conveniently added in the form of alloys or compounds that melt or dissolve into the cobalt phase. If desired, adjuvants may be introduced in the form of cobalt alloy powder. Adding separate adjuvant powders is preferred.

The preferred adjuvant materials include; (a) a material selected from the group IIIa, IVa and Va elements of the periodic table, or mixtures and alloys thereof, and (b) a material selected from the group IVb, Vb, and VIb transition metals of the periodic table, or mixtures and alloys thereof. In addition, adjuvant materials of the various groups may be added in combination. An alloy of a group IIIa element and a group VIII metal, in particular, $Co_2Al_9$, $NiAl_3$, NiAl and Fe-Al compounds, or mixtures thereof, is preferred.

When the charge in the high temperature, high pressure press reaches the melting point of the cobalt rich supporting phase in the cemented tungsten carbide, the cobalt melts and the liquid material infiltrates throughout the polycrystalline diamond and refractory material matrix, and sinters the compact. It is believed that the adjuvant materials, specifically the transition metals and the group IIIa, IVa, and Va elements, dissolve into the cobalt-rich liquid phase, thus alloying with the cobalt. The metal phase is sometimes referred to as a binder phase although bonding is intercrystalline between the diamond or CBN crystals. The metal phase catalyzes such intercrystalline bonding.

While not wishing to be bound by a particular theory, it is believed that transition metals, particularly refractory metals such as nickel and tungsten, alloyed with the cobalt in the supporting phase, stabilize the crystal structure of the cobalt. At ambient temperature, cobalt is stable as a hexagonal-close-packed crystal structure. At elevated temperatures, a phase transformation occurs which causes cobalt to be stable as a face-centered-cubic crystal structure. Since the lattice constants (atom-to-atom spacing) are appreciably different for a hexagonal-close-packed structure than for a face-centered-cubic crystal structure, the cobalt phase undergoes a consequent volume change which accompanies the phase change. Appreciable stress is generated within the PCD as a result of this volumetric change, which causes warping and cracking, and can lead to flaking of the PCD layer.

The transition metal alloying elements stabilize the lower temperature hexagonal-close-packed crystal structure of the cobalt to higher temperatures. Thus, a cutting tool made from a compact has greater resistance to friction heat generated in the cutting process when the tool is used.

In practice, a mixture containing up to 20% by weight relative to the cobalt phase, of transition metals, preferably nickel or tungsten, produces a compact having a reasonably high degree of thermal resistance suitable for woodworking operations.

Addition of alloying elements from the group IVb, Vb, and VIb transition metals to the cobalt phase enhance both the oxidation and corrosion resistance of the cobalt phase. Titanium, chromium, molybdenum, and the like, all form stable sulfide, chloride, and oxide compounds at lower temperatures than cobalt. Wood decomposition products such as sulphur and halide compounds, therefore, preferentially bond to the adjuvant material, thus allowing the cobalt to retain its integrity.

Oxidation resistance is provided by mixtures or alloys of the group IIIa, IVa, and Va materials, in particular, aluminum and silicon, which both form especially stable oxides at the temperatures of interest. Aluminum forms a particularly stable oxide, $Al_2O_3$, at lower temperatures than, for example, chromium. Aluminum oxide, silicon dioxide, and other group IIIa, IVa, and Va oxides form a surface layer on the PCD hard layer which is difficult to further oxidize. Although not as hard as either carbide or PCD/PCBN, the stable low temperature group IIIa, IVa, and Va oxides, particularly alumina, are significantly harder and less brittle than oxides of cobalt. Enhanced abrasion resistance is provided thereby.

After pressing, the compact is recovered from the press and further manufactured into a cutting tool of the desired size and shape.

The finished compact, when removed from the press, is either a circular or rectangular wafer comprising a PCD or PCBN layer sintered to a carbide substrate. A completed circular compact typically has a diameter of about 25 millimeters, while a rectangular compact has dimensions of about 5.2 millimeters by 6.5 millimeters.

The periphery of a composite compact is cut into the desired shape of the finished cutting tool by electrical discharge machining (EDM), a well known spark discharge cutting process. What is to be the leading or cutting surface of the tool is tapered, by beveling, to provide an acute angle between the front surface 16, termed the clearance face or rake face, and the upper surface of the tool, defined as the surface comprising the PCD or PCBN layer. The taper angle defined by the bevel is commonly measured against the original leading edge vertical and may be referred to as the rake angle. A suitable taper angle for a woodworking tool is between 10 and 30 degrees, preferably about 15 to 25 degrees.

Preferably, the top surface of the PCD or PCBN hard layer of the cutting tool is neither flat-ground nor lapped as in conventional finishing operations. Rather the PCD or PCBN hard surface remains "as sintered" in the completed cutting tool with only the clearance face ground to provide the proper taper angle. Forming a cutting tool with an "as sintered" hard surface results in an appreciable reduction in the initial wear of the cutting tool.

The surface features of the PCD or PCBN "as sintered" hard face are determined by the surface against which it is formed. In the compact manufacturing process the face of the preferred niobium can against which the compact is pressed, is emulated by the hard layer. Niobium presents a smooth surface to the compact hard layer which is transferred thereto and results in a smooth hard layer surface with little or no irregularities. If several compacts are to be formed in a can, a niobium disk is placed between each incipient compact. The adjacent compact surface conforms to the smooth surface of the disk.

The reduced thickness of the PCD or PCBN hard layer, as compared to conventional layer thicknesses, also allows the tool surface to remain "as sintered". Conventional compacts are manufactured with hard layer thicknesses of about 0.9 millimeter in order to provide sufficient bulk material in the hard layer to resist high stress forces during cutting and avoid breakage. When such a hard layer is formed on a carbide substrate, the top surface of the compact often bows away from flatness because of the thermal expansion differential between the PCD or PCBN and the carbide substrate, requiring the top surface of the cutting tool to be ground back to flatness by, for example, electrical discharge grinding (EDG).

A thin layer of about 0.3 millimeter thickness comprises insufficient bulk material to cause bowing in response to material thermal expansion mismatch between the hard layer and the carbide substrate. The top surface of a cutting tool with such a layer need not, therefore, be ground or lapped to achieve the desired flatness.

EXAMPLES

Six PCD and PCBN cutting tools of different grades were prepared using a matrix of finishes to determine their suitability for cutting medium density fiberboard (MDF).

Two 700 grade PCD tools were prepared, each with a different PCD layer thickness and top surface finish. The 700 grade PCD material has relatively large diamonds with average particle sizes of about 28 microns. The diamond grains are mixed with about three percent by weight titanium carbonitride and placed on a cemented tungsten carbide substrate. Cobalt phase infiltrates from the carbide substrate. The final PCD has about 15% by weight metal phase and a typical composition comprises about one percent titanium, about four percent tungsten and about eleven percent cobalt.

One tool was formed with a 700 grade PCD hard layer of about 0.6 millimeter thickness. The hard layer top surface was subsequently polished to a mirror finish in a well known manner with a Coburn machine. The second 700 grade PCD tool was formed with a PCD hard layer of about 0.3 millimeter thickness, whose surface parallel to the substrate was allowed to remain as-sintered or as-pressed.

Two 300 grade PCD tools were prepared, again each with a different PCD layer thickness and top surface finish. In contrast to 700 grade, the 300 grade PCD material comprises substantially smaller diamond particles with average particle sizes of, typically, about 5 microns. The metal content, largely infiltrated from the carbide substrate, is typically 17.3% by weight. An exemplary analysis of the metal phase is 3.2% tungsten, 1.6% titanium and 12.5% cobalt (relative to the total weight of the PCD material).

One tool was formed with a PCD hard layer of about 0.6 millimeter thickness, the top surface of which was subsequently mirror polished. The second 300 grade PCD tool was formed with a PCD hard layer of about 0.3 millimeter thickness, whose surface was again allowed to remain as-pressed.

Two additional tools were also prepared from PCBN grades, identified herein as MN-90, to determine the suitability of PCBN materials for woodworking applications. As for the PCD grades, the hard layer was formed with different thicknesses. The top surface of each tool was lapped from its as-pressed thickness to its final desired value; a standard 0.9 millimeter thickness in the first case, a 0.3 millimeter thickness in the second.

The MN-90 grade PCBN material comprises about 95% polycrystalline cubic boron nitride (CBN) and about 5% $Co_2Al_9$ on a carbide substrate. Cobalt infiltrates from the substrate yielding a metal phase of about 22% by weight. Alternatively, a PCBN material, comprising about 60% CBN, 32% TiCN and 8% $Co_2Al_9$ may be substituted for MN-90.

Further details of the composition and method for forming the MN-90 PCBN material are set forth in U.S. Pat. No. 5,271,749, the disclosure of which is expressly incorporated herein by reference.

Two cutting tools of each type were prepared for testing on medium density fiberboard (MDF). Each of the cutting tools were fabricated as regular cutters with a length of about 22 millimeters, a width of about 9.5 millimeters and a taper angle of about 25 degrees along the clearance face. The tool shape was defined by wire EDM cutting. Each tool, therefore, cuts with only an EDM quality edge.

Each tool was mounted, in turn, on a tool holder on a lathe with a mechanized feed system configured to press the tool against the edge of a rotating MDF disk about one inch thick and 18 inches (2.5 cm. by 45 cm.) in diameter. The tool holder included two transducers for monitoring the cutting forces as seen by the tool; the parallel force, tangential to the radius of the MDF disk (the force pushing down on the tool), and the normal force required to push the tool in the radial direction toward the center of the MDF disk at the feed rate.

All of the tests were conducted with a feed rate of about 0.008 inches (200 microns) per revolution, 330 disk revolutions per minute, 15 degree tool rake angle, and 10 degree tool clearance angle. The MDF disks were from the same material lot and each disk represented about 7050 inches (215 meters) of cutting distance. The tools each cut a total of about 42,300 inches (1300 meters) of MDF. The normal and parallel forces were measured, with the results, expressed in pounds, tabulated in Table 1.

TABLE 1

| Test No. | Type | Initial Avg. Normal Force | Final Avg. Normal Force | Initial Avg. Parallel Force | Final Avg. Parallel Force | Avg. Percent Change of Normal Force |
|---|---|---|---|---|---|---|
| 1 | PCD 700 Grade 0.6 mm, Polished | 8.8 | 17.5 | 13.8 | 17.3 | 98.8 |
| 2 | PCD 700 Grade 0.3 mm, As Sintered | 17.0 | 22.5 | 16.5 | 20.3 | 32.2 |
| 3 | PCD 300 Grade 0.6 mm, Polished | 7.0 | 14.3 | 12.3 | 17.3 | 104.3 |
| 4 | PCD 300 Grade 0.3 mm, As Sintered | 9.8 | 14.5 | 14.5 | 17.8 | 47.9 |
| 5 | PCBN MN-90 Grade 0.9 mm, Lapped | 14.8 | 17.0 | 16.0 | 18.0 | 14.8 |
| 6 | PCBN MN-90 Grade 0.3 mm, Lapped | 12.3 | 16.8 | 15.5 | 17.0 | 36.6 |

Inspection of the test results set forth in Table 1 indicates that the 300 grade, 0.6 millimeter PCD tool with a polished surface finish, returned the lowest overall cutting forces. However, the 300 grade, 0.3 millimeter, "as-sintered" PCD tool performed equally well. The final force values increased little over the initial force values, indicating that the cutting edges retained their sharpness and experienced little wear over the course of the test. Thus, a thinner, as-pressed PCD cutting tool may be used, thereby saving the cost of a surface finishing operation. Moreover, the PCBN grades, of both thicknesses, returned test results indicating their suitability for woodworking applications.

Suitability for woodworking requires the normal, or radial force to remain less than the parallel, or tangential force over the course of the test. When the requirement is met, it indicates the tool is cutting the particle board material. When the normal force exceeds the parallel force, it indicates the tool is "plowing" the material rather than cutting. Inspection of the cutting force data in Table 1 shows the suitability of the tested grades for woodworking, except the 700 grade PCD cutting tools. The plowing mode cross-over, where the normal force exceeds the parallel force, occurred early in the testing cycle for these grades and was maintained throughout the course of the test.

The smaller particle size of the 300 grade material can be formed to a sharper cutting edge, thereby making the initial normal force smaller than an edge formed from coarser 700 grade material.

A second test was performed, under the same conditions as the first, on the PCD 300 grade, 0.3 millimeter, "as-pressed" tool and the PCBN MN-90 grade, 0.9 millimeter, lapped tool. The tools were, however, provided with a finish ground edge, in contrast to the EDM machined edges of the preceding test. During finish grinding, 0.006 inches (150 microns) of material was removed from the tapered clearance faces of each tool. The results of the second test are summarized in Table 2.

TABLE 2

| Test No. | Type | Initial Avg. Normal Force | Final Avg. Normal Force | Initial Avg. Parallel Force | Final Avg. Parallel Force | Avg. Percent Change of Normal Force |
|---|---|---|---|---|---|---|
| 1 | PCD 300 Grade 0.3 mm, As Sintered | 12.0 | 14.0 | 15.0 | 16.5 | 16.6 |
| 2 | PCBN MN-90 Grade 0.9 mm, Lapped | 12.0 | 13.0 | 14.0 | 15.5 | 8.3 |

Finish grinding, as indicated by comparing the results of Table 2 with the results of Table 1, improves the performance of each of the tools. Neither the normal force nor the parallel force had particularly low initial values, but the difference between the initial force value and final force value markedly improved, in both cases, illustrating a substantial reduction in wear.

It is clear, from the cutting force data shown in Table 1 and Table 2, that cutting tools suitable for woodworking applications may be fabricated from composite PCD compacts having "thin" PCD hard layers, preferably about 0.3 millimeter thick, and "as sintered" top surfaces. Moreover, suitable woodworking cutting tools may be fabricated from PCBN composite compacts having a PCBN hard layer thickness of from about 0.3 millimeter to about 0.9 millimeter. Suitable tools may be prepared with wire EDM machined clearance face edges, for the lowest manufacturing cost, or with a finish ground clearance edge.

The resulting cutting tools are fabricated from PCD and/or PCBN compacts possessing advantageous qualities not found simultaneously in the prior art; namely, (1) a significantly lower level of residual internal stress resulting from a substantially thinner PCD or PCBN hard layer, resulting in high resistance to supporting phase erosion by abrasive materials, (2) a significantly lower manufacturing cost due, in part, to the "as sintered" surface for PCD grades, and the reduced thickness of the hard layer for PCD and PCBN grades, (3) high wear resistance under aggressive woodcutting conditions, (4) high thermal stability of the supporting phase, (5) low coefficient of friction, and (6) lack of chemical or metallurgical reaction with the workpiece through oxidation and corrosion resistance.

It is possible within the scope of this invention to practice a wide variety of compositions and temperature and pressure conditions in cycles which will achieve the same objective as these examples, and the foregoing examples are designed to be illustrative rather than limiting. For example, while cubic boron nitride is the preferable high pressure boron nitride phase, the compacts may be made using wurzitic boron nitride or a mixture of cubic and wurzitic boron nitride as a starting material. Some hexagonal boron nitride may be included as a raw material for conversion to cubic boron nitride in the super pressure press. Additionally, a small amount of tungsten carbide may be used as refractory material. Since many such variations may be made, it is to be understood that within the scope of the following claims, this invention may be practiced otherwise than specifically described.

What is claimed is:

1. A cutting tool adapted for woodworking applications comprising:

a substrate; and a hard layer bonded to the substrate at high temperature and high pressure, the hard layer comprising three phases, namely:

at least one material selected from the group consisting of polycrystalline diamond and polycrystalline cubic boron nitride, a refractory material selected from the group consisting of titanium carbonitride and titanium aluminum carbonitride, and a cobalt phase including a sufficient amount of corrosion resistant adjuvant alloying material selected from the group consisting of titanium, chromium and molybdenum for providing resistance to corrosion by sulphurous and halide byproducts of machining wood products.

2. A cutting tool adapted for woodworking applications comprising:

a substrate; and a hard layer bonded to the substrate at high temperature and high pressure, the hard layer comprising three phases, namely:

at least one material selected from the group consisting of polycrystalline diamond and polycrystalline cubic boron nitride, a refractory material selected from the group consisting of titanium carbonitride and titanium aluminum carbonitride, and a cobalt phase including a sufficient amount of oxidation resistant adjuvant alloying material selected from the group consisting of aluminum containing materials and silicon containing materials for providing resistance to oxidation by byproducts of machining wood products.

3. A cutting tool according to claim 2 wherein the hard layer has a thickness of about 0.3 millimeter and an as-pressed surface.

4. A cutting tool adapted for woodworking applications comprising:

a substrate; and a hard layer bonded to the substrate at high temperature and high pressure, the hard layer comprising:

at least one material selected from the group consisting of polycrystalline diamond and polycrystalline cubic boron nitride, and a metal supporting phase; and a cutting edge adjacent a face which is at an acute angle to the interface between the substrate and hard layer; and wherein the hard layer has an as-pressed surface parallel to the interface and a thickness of up to about 0.3 millimeter.

5. A cutting tool according to claim 4 wherein the supporting phase comprises cobalt and at least one material selected from the group consisting of nickel, aluminum, silicon, titanium, molybdenum and chromium.

6. A cutting tool according to claim 4 wherein the metal supporting phase comprises cobalt and a material that retards phase transformation from a hexagonal-close-packed crystal structure to a face-centered-cubic crystal structure at elevated temperature.

7. A cutting tool according to claim 4 wherein the substrate comprises cemented tungsten carbide.

8. A cutting tool adapted for woodworking applications comprising:

a substrate; and a hard layer bonded to the substrate at high temperature and high pressure, the hard layer comprising:

at least one material selected from the group consisting of polycrystalline diamond and polycrystalline cubic boron nitride, and a cobalt supporting phase including a sufficient amount of an alloying metal to retard phase transformation of cobalt from a hexagonal-close-packed crystal structure to a face-centered-cubic crystal structure at elevated temperature; and a curing edge adjacent a face which is at an acute angle to the interface between the substrate and hard layer; and wherein the hard layer has a thickness of about 0.3 millimeter and an as-pressed surface.

9. A cutting tool according to claim 8 wherein the cobalt phase includes an alloying metal selected from the group consisting of nickel and tungsten in an amount up to 20 percent by weight of the cobalt phase.

* * * * *